US006369368B2

(12) United States Patent
Graf et al.

(10) Patent No.: US 6,369,368 B2
(45) Date of Patent: Apr. 9, 2002

(54) TENSION-ADJUSTABLE EXPANDING DEVICE

(75) Inventors: Martin Graf, Dübendorf (CH); Martin Lohner, Ballingen (DE)

(73) Assignee: APAG Elektronik AG, Dubendorf (CH)

( * ) Notice: Subject to any disclaimer, the term of this patent is extended or adjusted under 35 U.S.C. 154(b) by 0 days.

(21) Appl. No.: 09/872,119

(22) Filed: Jun. 1, 2001

(51) Int. Cl.[7] ..... H05B 3/06
(52) U.S. Cl. ..... 219/526; 403/28
(58) Field of Search ..... 219/526, 536; 403/28

(56) References Cited

U.S. PATENT DOCUMENTS

| | | | | | |
|---|---|---|---|---|---|
| 5,127,780 | A | * | 7/1992 | Massa | 279/2.01 |
| 5,174,585 | A | * | 12/1992 | Erkki | 279/2.07 |
| 5,630,671 | A | * | 5/1997 | Larson | 29/447 |
| 5,674,027 | A | * | 10/1997 | Warnaar | 16/297 |
| 5,716,157 | A | * | 2/1998 | Kester et al. | 219/68 |
| 5,771,742 | A | * | 6/1998 | Bokaie et al. | 337/140 |
| 5,927,890 | A | * | 7/1999 | Job et al. | 403/2 |

FOREIGN PATENT DOCUMENTS

| | | |
|---|---|---|
| GB | 1171363 | 11/1969 |

* cited by examiner

*Primary Examiner*—Teresa Walberg
*Assistant Examiner*—Vinod D Patel
(74) *Attorney, Agent, or Firm*—Polster, Lieder, Woodruff & Lucchesi

(57) ABSTRACT

The invention concerns an expanding device (1) comprising two parts (heating elements 3,4) which can be moved relative to one another against the action of a spring element (11), wherein the spring element (11) is disposed between the two parts (heating elements 3,4) and abuts both parts (heating elements 3,4) with one external leg (12,13) each, a tensioning element (21) which can be displaced at a right angle to the direction of movement (14,15) of the two parts (heating elements 3,4) and is surrounded by a central connecting leg (18) of the spring element (11), and a counter bearing (20) on which the connecting leg (18) is supported in a tensioning direction (21') of the tensioning element (21), wherein at least in the tension-free state, a section (16,17) of the connecting leg (18) cooperating with the tensioning element (21) in the tensioning direction (21') is oriented at an inclined angle to the tensioning direction (21') thereby forcing the parts to an abutment or wall and holding them in position.

13 Claims, 2 Drawing Sheets

TENSION-ADJUSTABLE EXPANDING DEVICE

CROSS-REFERENCE TO RELATED APPLICATIONS

Not Applicable

STATEMENT REGARDING FEDERALLY SPONSORED RESEARCH OR DEVELOPMENT

Not Applicable.

BACKGROUND OF THE INVENTION

The invention concerns an expanding device, in particular for heating elements for heating up a liquid.

Stationary positioning of structural members on largely flat housing walls is a problem in the most different technical fields. It is possible to e.g. screw, glue or hold the structural members by means of holding shackles to the housing walls.

If the connection between structural member and housing wall comes loose due to aging or heating up, the structural member must be fastened again or the connection must at least be adjusted. If the housing is built into a larger unit with difficult access, maintenance of the connection between structural member and housing is almost impossible.

This problem can be shown with the example of a heating pocket of an additional electric heater of a combustion engine. Heating elements for heating a liquid, e.g. cooling water in a combustion engine, are disposed in the housing of heating pockets of an additional electric heater of a combustion engine, wherein the liquid to be heated flows around the heating pockets. To ensure an optimum heat transfer from the heating elements to the liquid to be heated, the heating elements must be mounted to the inner side of the housing of the heating pockets. It takes a lot of time to screw each heating element individually or fasten it via a clamp. Gluing of heating elements is also time-consuming and a glued joint does not last very long due to the high temperatures of the heating elements. Additionally, mounting of insulating discs between the heating elements and the housing of the heating pockets for electrical insulation of the heating elements of a glued joint is not easy and the contact pressure exerted on the wall cannot be adjusted with either a glued connection or a clip connection. In an assembled additional electric heater of a combustion engine, the heating pockets are not accessible and consequently, control and maintenance of the connections between structural member and housing wall is not possible.

It is therefore the underlying purpose of the present invention to develop a device which permits simple and maintenance-free mounting of elements to a wall and adjustment of the contact pressure of the element to the wall.

SUMMARY OF THE INVENTION

This object is achieved in accordance with the invention by an expanding device comprising two parts which can be moved relative to one another against the action of a spring element, wherein the spring element is disposed between the two parts and abuts both parts with one external leg each, a tensioning element which can be displaced at a right angle to the direction of movement of the two parts and is surrounded by a central connecting leg of the spring element, and a counter bearing on which the connecting leg is supported in a tensioning direction of the tensioning element, wherein at least in the tension-free state, one section of the connecting leg cooperating with the tensioning element in the tensioning direction, is oriented at an inclined angle to the tensioning direction.

The spring element already has an initial tension during installation, urging the part(s) to be installed against an abutment or wall with a slight contact pressure thereby keeping it (them) in position. Then, the contact pressure can be increased or adjusted via the tensioning element in that it acts on one or more sections of the connecting leg of the spring element such that the external legs of the spring element are expanded and the part(s) is (are) thus forced with increased pressure against the abutment. Since the spring element is an elastic element, the geometrical changes of the part(s) due to aging or thermal influences are compensated for. Renewed adjustment of the contact pressure and maintenance are therefore not necessary. The spring element is preferably designed to be symmetrical to the central plane between the two parts such that the two opposite parts can be held and mounted in position at opposite walls with only one spring element.

The counter bearing is preferably disposed such that the outer end of the connecting leg is supported thereon. It is also feasible to dispose the counter bearing in a region between the sections of the connecting leg cooperating with the tensioning element and the external legs of the spring element.

The tensioning element is preferably a round part. A round part is easy to install and can slide in a particularly easy fashion along the sections of the connecting leg oriented at an inclined angle to the tensioning direction without jamming.

In a preferred embodiment of the inventive expanding device, the section is flat which achieves a particularly good and effective cooperation with the tensioning element formed as round part.

Forming of the spring element as a wire requires little material for manufacturing of the spring element and introduction of the tensioning element into the connecting leg is particularly easy without jamming.

Alternatively, the spring element may be formed as a band. In that case, at least sections of the spring element can abut flatly on the tensioning element and on the parts to be mounted. Twisting of the spring element relative to the tensioning element or the parts to be expanded is thereby largely prevented.

Sliding off of the connecting leg from the counter bearing is prevented if the counter bearing comprises a supporting seat for the connecting leg of the spring element. This applies in particular, if the supporting seat is formed as a groove and the shape of the connecting leg is adapted to the groove.

In a particularly preferred embodiment of the inventive expanding device, the expanding device comprises a means for changing the distance between the tensioning element and the counter bearing. Reduction of the distance between tensioning element and counter bearing urges the spring element against the counter bearing, thereby expanding or spreading the external legs of the spring element located in the region between the parts which can be moved relative to one another, thereby permitting adjustment of the contact pressure of a part to be mounted to an abutment.

Advantageously, the means for changing the distance between tensioning element and counter bearing is at least one screw connection acting therebetween. The distance can be set with great precision via a screw connection and the distance cannot be changed once it has been set.

In a particularly preferred embodiment of the inventive expanding device, at least one of the two parts is provided with an abutment surface and an insulating layer is disposed between the abutment surface and the at least one part. Depending on the part used, it may be required to electrically insulate the part from the abutment. The insulating layer can be clamped between the part and the abutment such that the insulating layer is held in position mediately via the spring element. For this reason, additional fastening devices for the insulating layer are not required.

If the counter bearing is formed by at least one of the two parts, a separate counter bearing is not required. Separate production and installation of the counter bearing is not required which saves time and material.

If at least one of the two parts is a heating element, the expanding device can be used for the mounting of heating elements in heating pockets of e.g. additional electrical heaters of combustion engines. In particular heating elements permit gluing only to a limited degree since the glue would possibly dissolve at these temperatures. Furthermore, the inventive expanding device permits faster installation and maintenance or re-adjustment of the contact pressure is not required.

In a further preferred embodiment, the tensioning elements of several expanding devices disposed behind or next to one another are formed by a common tensioning element. The tensioning element thereby cooperates with the sections of the connecting legs of several spring elements at the same time. It is therefore possible to re-tension several spring elements with only one tensioning element thereby simultaneously setting the contact pressure of several parts against an abutment.

Further advantages of the invention can be extracted from the description and the drawing. The features mentioned above and below can be used in accordance with the invention either individually or collectively in any arbitrary combination. The embodiments shown and described are not to be understood as exhaustive enumeration but rather have exemplary character for describing the invention.

BRIEF DESCRIPTION OF THE DRAWINGS

The invention is shown in the drawing and explained in more detail with reference to embodiments.

DESCRIPTION OF THE PREFERRED EMBODIMENTS

Figure 1:
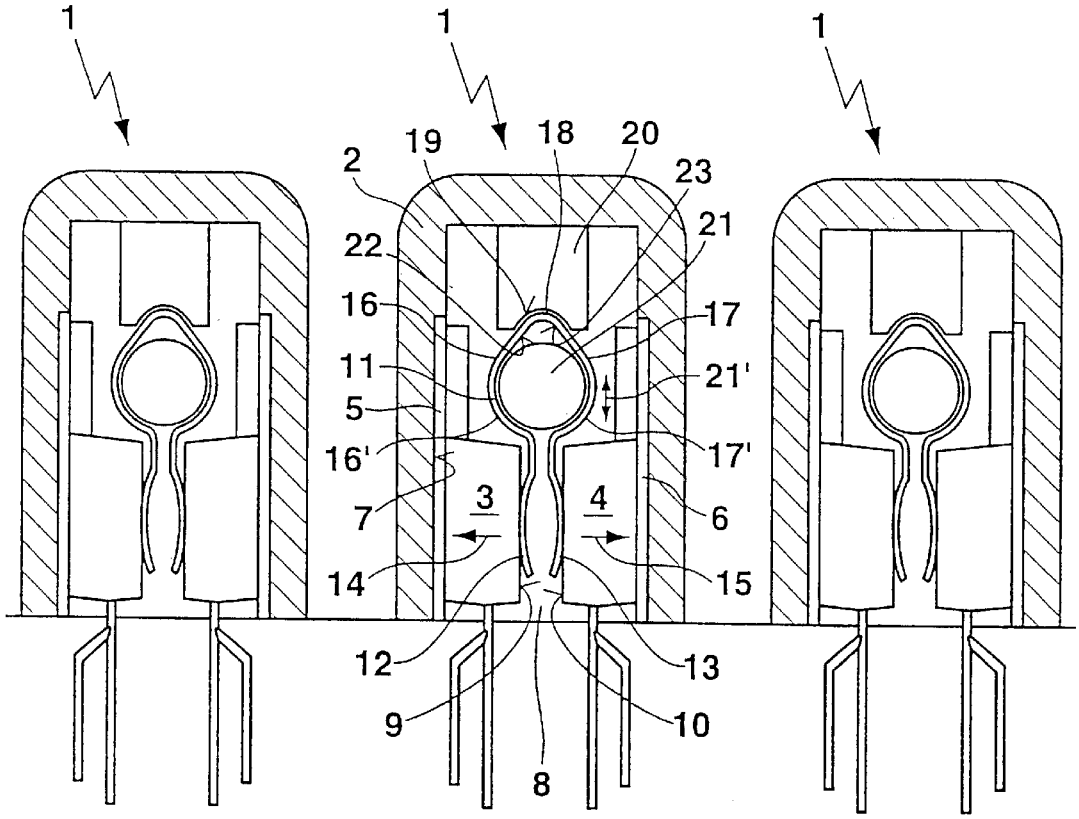
FIG. 1 shows a section through an inventive expanding device.

FIG. 1 shows a section through an expanding device 1 disposed in a heating pocket of an additional electrical heater of a combustion engine. The housing 2 of the heating pocket is formed by an aluminum diecast housing and is surrounded by a fluid to be heated. Several heating elements 3,4 are situated within the housing 2, which abut with one side each on an electrically insulating layer 5,6 formed as a disc. The insulating layer 5,6 is located between the housing inner wall 7 and a heating element 3,4. The heating elements 3,4 are power semiconductors, in particular power transistors, which are disposed such that two heating elements 3,4 are disposed opposite to one another with their sides 9,10 facing away from the insulating layer 5,6 and being separated by a gap 8. The heating elements 3,4 are held in position through a spring element 11 located partly within the gap 8 between the heating elements 3,4. The one-piece spring element 11 has two external legs 12,13 with bends facing in opposite directions within the gap 8 such that an approximately elliptical cavity is formed between the external legs 12,13. Sections of the outer sides of the external legs 12,13 abut the sides 9,10 of the heating elements 3,4 and force the heating elements 3,4 in the direction of the arrows 14,15 against the insulating layer 5,6. The tensioning element 11, which is symmetrical to its longitudinal axis, forms almost a semi-circle outside the gap 8 through two curved legs 16',17', which are followed by two sections 16,17 of a connecting leg 18. The curved end of the connecting leg 18 is adapted to the shape of a groove 19 of a counter bearing 20 into which it engages. A tensioning element 21, formed as a round part, is located within the free space formed by the curved legs 16',17' and sections 16,17 and abuts at least on the inner sides 22,23 of the sections 16,17. Displacement of the tensioning element 21 relative to the counter bearing 20 in the tensioning direction 21', i.e. at a right angle to the directions of the arrows 14,15, permits expansion of the external legs 12,13 in the direction of the arrows 14,15, thus enabling re-tensioning of the spring element 11.

Figure 2:
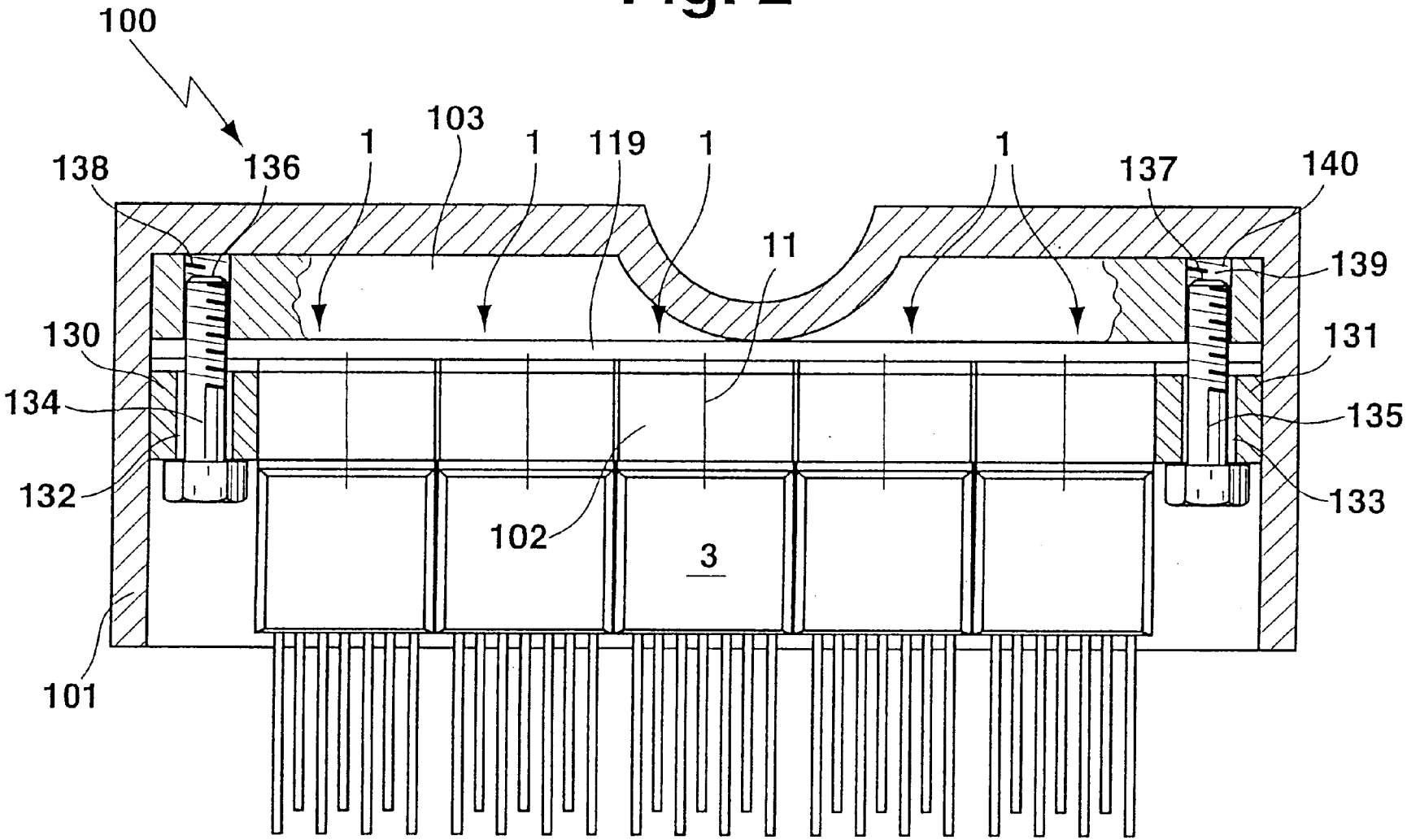
FIG. 2 shows a section through an arrangement of several inventive expanding devices perpendicular to the section of FIG. 1.

FIG. 2 shows a cross-section through an arrangement 100 of five neighboring expanding devices 1 perpendicular to the plane of the drawing of FIG. 1. The housing 101 of the arrangement 100 is surrounded by a fluid to be heated. The spring elements 11 are indicated by a vertical line. Both ends 130,131 of the common tensioning element 102 are provided with openings 132,133 through which one screw 134,135 each is guided. The front end 136,137 of the screw 134,135 is guided in a thread 138,139 which is located in the common counter bearing 103. The distance between the tensioning element 102 encompassed by the connecting leg 18 and the counter bearing 103 can be altered via the screw 134,135. Fastening of the screws 134,135 presses the curved end of the connecting leg 18 into the groove 119 of the counter bearing 103 and simultaneously moves the sections 16,17 to the top and apart. Consequently, the external legs 12,13 are also moved apart, thereby pressing the heating elements 3,4 with more force to the insulating layer 5,6 abutting the housing inner wall 7. The insulating layer 5,6 is thereby clamped between the heating elements 3,4 and the housing inner wall 7 and indirectly held in position through the spring element 11. Mounting of the heating elements 3,4 and the insulating layer 5,6 is effected with a slight contact pressure. As soon as all parts are in the desired position, they are re-tensioned via the tensioning element 102 and the screw connection such that a pre-determined contact pressure is achieved. Geometrical changes due to aging, thermal influences etc. are compensated for by the spring element 11, thereby ensuring that the heating elements 3,4 optimally abut the housing inner wall 7 by means of the insulating layer 5,6 and ensuring optimum heat transfer, even after prolonged operation.

What is claimed is:

1. An expanding device for displacing two parts relative to each other against the action of a spring element; the expanding device including:

the spring element having a pair of external legs extending from opposite ends of a central connecting leg, the spring element being is disposed between the two parts with an external leg abutting each of said parts;

a tensioning element which can be displaced at a right angle to the direction of movement of the two parts; said tensioning element being surrounded by said central connecting leg of the spring element; and a counter bearing engaged by the connecting leg in one tensioning direction of the tensioning element, wherein at least in the tension-free state, a section of the connecting leg, which cooperates with the tensioning element in the tensioning direction, is oriented at an inclined angle to the tensioning direction.

2. The expanding device according to claim 1, wherein the tensioning element is a round part.

3. The expanding device according to claim 1, wherein the section of the connecting leg which cooperates with the tensioning element is flat.

4. The expanding device according to claim 1, wherein the spring element is wire-shaped.

5. The expanding device according to claim 1, wherein the spring element has the shape of a band.

6. The expanding device according to claim 1, wherein the counter bearing is provided with a support seat for the connecting leg of the spring element.

7. The expanding device according to claim 1, wherein the expanding device comprises a means for changing the distance between the tensioning element and the counter bearing.

8. The expanding device according to claim 7, wherein the means for changing the distance between the tensioning element and the counter bearing comprises at least one screw connection acting therebetween.

9. The expanding device according to claim 1, wherein an abutment surface is provided for at least one of the two parts and that an insulating layer is disposed between the abutment surface and the at least one part.

10. The expanding device according to claim 1, wherein the counter bearing is formed through at least one of the parts.

11. The expanding device according to claim 1, wherein at least one of the two parts is a heating element.

12. The expanding device according to claim 1, wherein the tensioning element is a round part, the section of the connecting leg which cooperates with the tensioning element is flat, the counter bearing is provided with a support seat for the connecting leg of the spring element, the expanding device comprises a means for changing the distance between the tensioning element and the counter bearing, the means for changing the distance between the tensioning element and the counter bearing is at least one screw connection acting therebetween, an abutment surface is provided for at least one of the two parts and that an insulating layer is disposed between the abutment surface and the at least one part, the counter bearing is formed through at least one of the parts, and at least one of the two parts is a heating element.

13. An arrangement having several expanding devices disposed behind or next to one another, each expanding device comprising two parts which can be displaced relative to one another against the action of a spring element, wherein the spring element is disposed between the two parts and abuts both parts with one external leg each, a tensioning element which can be displaced at a right angle to the direction of movement of the two parts which is surrounded by a central connecting leg of the spring element, and a counter bearing on which the connecting leg is supported in one tensioning direction of the tensioning element, wherein at least in the tension-free state, a section of the connecting leg, which cooperates with the tensioning element in the tensioning direction, is oriented at an inclined angle to the tensioning direction and wherein the tensioning elements of the individual expanding devices are formed by a common tensioning element.

* * * * *